US010184762B2

(12) United States Patent
Summers et al.

(10) Patent No.: US 10,184,762 B2
(45) Date of Patent: Jan. 22, 2019

(54) BASE DRAG REDUCTION FAIRING USING SHAPE MEMORY MATERIALS

(71) Applicant: RAYTHEON COMPANY, Waltham, MA (US)

(72) Inventors: Matthew H. Summers, Marana, AZ (US); Frederick B. Koehler, Tucson, AZ (US); Jeremy C. Danforth, Tucson, AZ (US); James K. Villarreal, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 366 days.

(21) Appl. No.: 14/956,169

(22) Filed: Dec. 1, 2015

(65) Prior Publication Data

US 2017/0153096 A1 Jun. 1, 2017

(51) Int. Cl.

| | |
|---|---|
| ***F42B 10/38*** | (2006.01) |
| ***B63G 8/00*** | (2006.01) |
| ***F42B 10/14*** | (2006.01) |
| ***F42B 10/40*** | (2006.01) |
| ***F42B 10/44*** | (2006.01) |

(52) U.S. Cl.

CPC ..... *F42B 10/38* (2013.01); *B63G 8/00* (2013.01); *F42B 10/14* (2013.01); *F42B 10/40* (2013.01); *F42B 10/44* (2013.01)

(58) Field of Classification Search

CPC ..... F42B 10/14; F42B 10/44; F42B 10/38; F42B 15/01; B64C 2201/102

See application file for complete search history.

(56) References Cited

U.S. PATENT DOCUMENTS

| | | | | |
|---|---|---|---|---|
| 4,348,957 A | | 9/1982 | White et al. | |
| 4,674,706 A | | 6/1987 | Hall | |
| 6,126,109 A | * | 10/2000 | Barson | F42B 10/14 244/3.28 |
| 6,297,486 B1 | * | 10/2001 | Rom | F42B 10/44 102/385 |
| 6,657,174 B1 | | 12/2003 | Olsson | |

(Continued)

FOREIGN PATENT DOCUMENTS

| | | | | |
|---|---|---|---|---|
| GB | 2394029 A | * | 4/2004 | F42B 10/44 |
| JP | 2014224534 A | * | 12/2014 | F02K 1/1207 |
| WO | WO-2010065172 A2 | * | 6/2010 | F42B 12/34 |

OTHER PUBLICATIONS

International Search Report and Written Opinion of the International Searching Authority dated May 16, 2017 in connection with International Patent Application No. PCT/US2016/055229.

*Primary Examiner* — Benjamin P Lee

(57) ABSTRACT

A device is provided. The device includes at least one SMM component fabricated from an SMM. The SMM component is configured to change shape in response to receiving a stimulus. The SMM component is also configured to deploy from a device body of the device allowing the device to change shape in an advantageous way. A method implemented by a device is also provided. The method includes changing a shape of an SMM component of the device in response to receiving a stimulus. The SMM component is fabricated from an SMM. The method also includes deploying the SMM component from a device body of the device allowing the device to change shape in an advantageous way.

20 Claims, 7 Drawing Sheets

(56) References Cited

U.S. PATENT DOCUMENTS 6,685,143 B1 * 2/2004 Prince ..... B64C 5/12 244/203
6,886,775 B2 5/2005 Johnsson et al.
6,923,123 B2 * 8/2005 Rastegar ..... F42B 10/146 102/400
7,150,232 B1 12/2006 Rastegar
7,997,205 B2 8/2011 Greenwood et al.
8,058,595 B2 * 11/2011 Koehler ..... B64C 1/36 244/121
8,312,813 B2 * 11/2012 McDermott ..... F42B 10/44 102/473
8,487,227 B2 * 7/2013 Rastegar ..... F42B 10/44 102/490
8,552,351 B2 * 10/2013 Geswender ..... F42B 10/64 244/3.27
8,584,987 B2 11/2013 Madsen et al.
8,997,454 B2 * 4/2015 Papamoschou ..... F02K 1/383 181/220
9,429,400 B1 * 8/2016 Sowle ..... F42B 10/02
9,637,223 B1 * 5/2017 DiCocco ..... B64C 21/00
2003/0047645 A1 * 3/2003 Rastegar ..... F24B 4/26 244/3.24
2004/0011919 A1 * 1/2004 Johnsson ..... F42B 10/16 244/3.29
2004/0021034 A1 * 2/2004 Hellman ..... F42B 10/14 244/3.28
2004/0129839 A1 * 7/2004 Patel ..... B64C 21/025 244/204
2005/0229806 A1 * 10/2005 Johnsson ..... F42B 10/14 102/490
2009/0283936 A1 * 11/2009 Sanderson ..... B29C 44/56 264/413
2009/0314890 A1 12/2009 Koehler
2010/0037588 A1 * 2/2010 Baltas ..... F02K 1/08 60/226.3
2010/0282116 A1 * 11/2010 Greenwood ..... F42B 10/38 102/501
2011/0024550 A1 * 2/2011 McDermott ..... F42B 10/44 244/3.27
2011/0271864 A1 * 11/2011 Rastegar ..... F42B 10/44 102/517
2012/0187235 A1 * 7/2012 Bergmann ..... F42B 10/64 244/3.22
2012/0210901 A1 * 8/2012 Bender ..... F42B 10/16 102/374
2014/0338324 A1 * 11/2014 Jasklowski ..... F02K 1/1207 60/527
2015/0108268 A1 4/2015 Lyman et al.
2015/0119479 A1 4/2015 Koehler
2016/0187111 A1 * 6/2016 Rastegar ..... F42B 17/00 102/438
2016/0216086 A1 * 7/2016 Rastegar ..... F42B 4/26
2016/0297552 A1 * 10/2016 Moser ..... B64G 1/222
2017/0146328 A1 * 5/2017 Rastegar ..... F42B 10/18
2017/0314896 A1 * 11/2017 Rastegar ..... F42B 15/10
2017/0314897 A1 * 11/2017 R ..... F42B 15/10
2017/0343328 A1 * 11/2017 Rastegar ..... F42B 10/18

* cited by examiner

BASE DRAG REDUCTION FAIRING USING SHAPE MEMORY MATERIALS

TECHNICAL FIELD

The present disclosure is directed in general to projectile devices and, more particularly, to deployable control devices to increase the range of projectile devices.

BACKGROUND OF THE DISCLOSURE

Projected devices, such as mortars, bullets, grenades, missiles, rockets, and the like, have incorporated components to increase their projectile range. Components to increase the range of projected devices can include aerodynamic surfaces controlled by motors and servos which can be costly, increase the weight of the projected device, create unwanted drag on the projected device, and can be difficult to install in current projected devices. There is, therefore, a need in the art for an improved component to increase the range of projected devices.

SUMMARY OF THE DISCLOSURE

To address one or more of the above-deficiencies of the prior art, embodiments described in this disclosure provide a device to be projected that includes a deployable component comprising a shape memory material (SMM).

In a first embodiment, a device is provided. The device includes at least one SMM component fabricated from an SMM. The SMM component is configured to change shape in response to receiving a stimulus. The SMM component is also configured to deploy from a device body of the device allowing the device to change shape in an advantageous way.

In a second embodiment, a device is provided. The device includes at least one SMM component fabricated from an SMM. The SMM component is configured to change shape in response to receiving a stimulus. The SMM component is also configured to cause a deployable component to deploy from a device body of the device allowing the device to change shape in an advantageous way.

In a third embodiment, a method implemented by a device is provided. The method includes changing a shape of an SMM component of the device in response to receiving a stimulus. The SMM component is fabricated from an SMM. The method also includes deploying the SMM component from a device body of the device allowing the device to change shape in an advantageous way.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

It should be understood at the outset that, although example embodiments are illustrated below, the present invention may be implemented using any number of techniques, whether currently known or not. The present invention should in no way be limited to the example implementations, drawings, and techniques illustrated below. Additionally, the drawings are not necessarily drawn to scale.

Any object moving through air is subject to various forces that act in a direction opposed to the direction of motion and thus tend to retard the motion. One such force, commonly called base drag, is caused by a low pressure region formed behind a moving object. The moving object leaves a partial vacuum in the space that the object has just vacated. Base drag is particularly severe for objects, such as devices and trucks, which end abruptly with a rear surface roughly normal to the direction of motion. The base drag of devices may be reduced by increasing turbulence near the rear of a device such that the adjacent air fills the space being vacated by the moving device more quickly.

Figure 1:
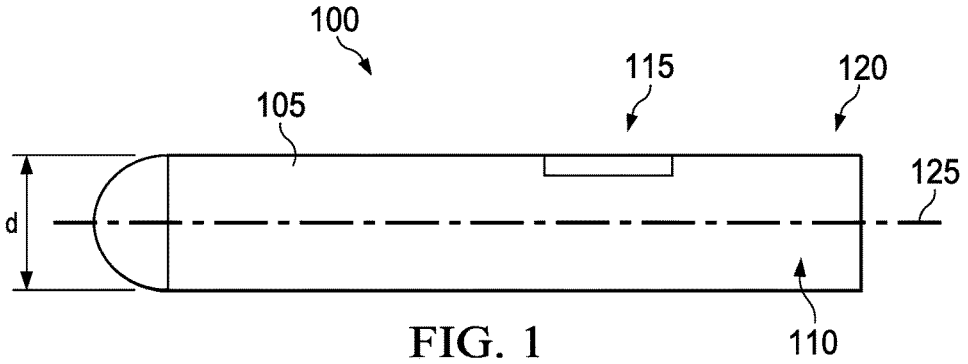
FIGS. 1 and 2 illustrate an example device according to this disclosure.

FIG. 1 illustrates an example device 100 according to this disclosure. The example device 100 can include a mortar, a bullet, a grenade, a missile, a rocket, a submersible, or the like. As shown in FIG. 1 the device 100 includes a device body 105, one or more control surfaces 115, and one or more fins 120. The body 105 includes a device base 110. The device body 105 and the device base 110 can be rotationally symmetric about a device axis 125 and can have a circular cross section with a maximum diameter d. A plurality of fins 120 can be deployed from the device base 110. In the case of a guided device, one or more control surfaces 115 can be disposed on the device body 105. In the example of FIG. 1, the control surfaces 115 can be a plurality of canards disposed on the device body 105 forward of the plurality of fins 120. The control surfaces 115 can be canards, fins, wings, scoops, brakes, or the like usable to control the trajectory of the device 100.

In accordance with the principles of this disclosure, the rear surface of the device base 110 can have right angles relative to the device axis 125. These right angles can be changed to a more aerodynamically advantageous form as soon as the device 100 leaves the barrel of an artillery gun from which it is fired. This can be achieved by transforming the right angled rear surface of the device base 110 to a conical tail thereby increasing the air turbulence to more quickly fill the space being vacated by the moving device 100 in order to reduce the drag. Furthermore, when the device 100 leaves the barrel of the artillery gun from which it is fired, the control surfaces 115 are deployed to control the trajectory of the device 100. Spaces that remain from the deployed control surface 115 can also be filled to further reduce drag on the device 100.

Figure 2:
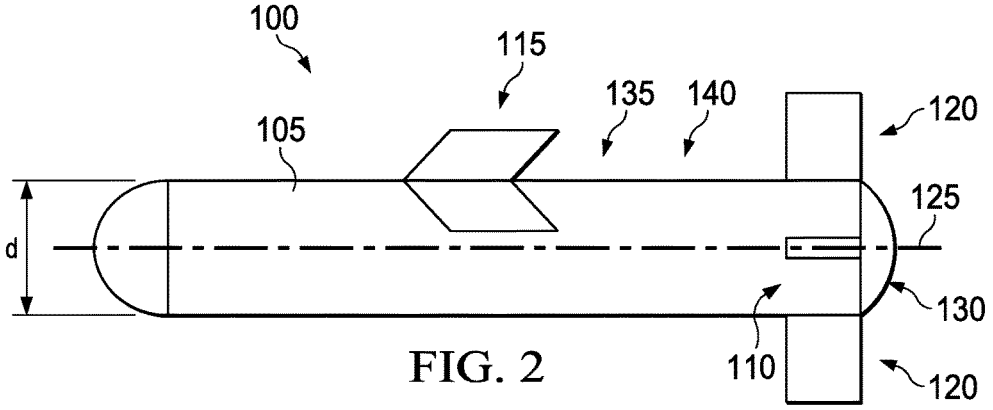

FIG. 2 illustrates the example device 100 after deployment according to this disclosure. Similar to FIG. 1, FIG. 2 illustrates the device 100 with the device body 105 with a device base 110, one or more control surfaces 115, and one or more fins 120. The device body 105 and the device base 110 can be rotationally symmetric about a device axis 125 and can have a circular cross section with a maximum diameter d. As shown in FIG. 2, a portion of the device base 110 proximate a back end of the device 100 has deployed a fairing 130, such as taper or boat tail, to reduce base drag when the device 100 is traveling through air. Furthermore, the one or more control surfaces 115 and the one or more fins 120 are deployed from the device body 105 to control the device trajectory. Spaces or gaps 135 and 140 that the one or more control surfaces 115 and the one more fins 120 pass through to deploy remain causing additional drag when the device 100 is traveling through the air.

As will be discussed herein, the fairing 130, the one or more control surfaces 115, and the one or more fins 120 are deployed using shape memory materials (SMMs). Further, the spaces 135 and 140 can be covered or filled to create a seamless surface on the device body 105 using SMMs. The fairing 130, the one or more control surfaces 115, and the one or more fins 120 can include a three-dimensional (3-D) printed conductive plastic, electric propellant, a thermal insulation combined with SMMs. SMMs are materials that have the ability to recover their original shape from a significant and seemingly plastic deformation based on an application of a particular stimulus. SMMs include shape memory polymers (SMPs) and shape memory alloys (SMAs). SMPs are polymeric materials that may be molded or printed to a shape, warmed to be above a glass transition temperature and packaged into a temporary shape. SMPs can then be cooled and stored in the temporary shape (without any retention force). Upon Subsequent heating, if left unrestrained, the structure of the SMP will regain its molded, printed, or "memorized" shape. There are two different forms of SMA's: superelastic and shape memory. The shape memory formulation are alloys that have a memorized shape that may be programmed at a very high temperature (in the case of Nitrol, this temperature is around 500 degrees Celsius). Once programmed, the material may be packaged at a lower temperature into a temporary shape that is below the storage temperature. When activation is desired, the structure may be heated to above the activation temperature or austenite finish temperature and it will forcefully return to its memorized shape. A typical austenite finish temperature for a shape memory formulation would be around 100 degrees Celsius. The superelastic SMA formulation operates consistently above the activation or austenite finish temperature. A typical austenite finish temperature for a superelastic formulation would be around zero degrees Celsius. The superelastic SMA device may be packaged into shapes at very high strain then restrained in that shape. When activation is desired, the device may simply be released. Stimuli for SMMs can include electric heat input (such as joule heating), chemical input (such as a gas generator), or both electric heat input and chemical input (such as electric propellant). In an embodiment, a stimulus can include aero-heating.

Although FIGS. 1 and 2 illustrate an example device 100, various changes may be made to FIGS. 1 and 2. For example, the device 100 could be a missile, a rocket, a submersible, or the like. Also, the makeup and arrangement of the device 100 in FIGS. 1 and 2 is for illustration only. Components could be added, omitted, combined, or placed in any other suitable configuration according to particular needs.

Figure 3B:
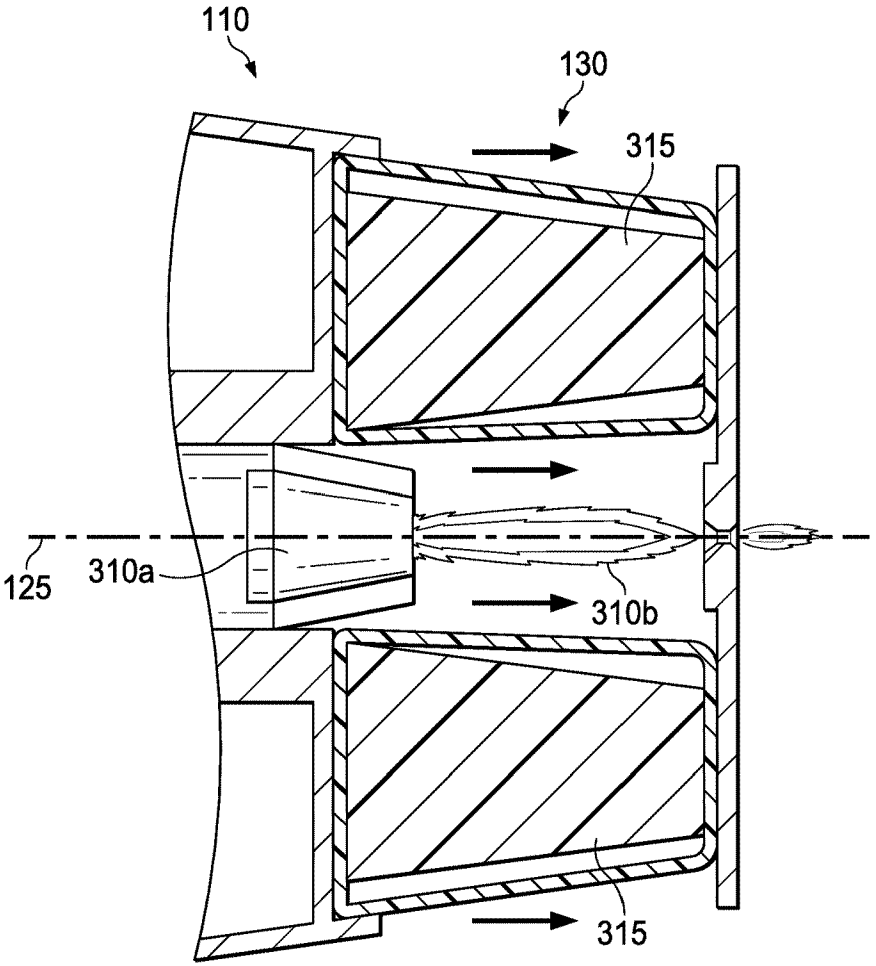
FIGS. 3A and 3B illustrate an example device base of a projected device according to this disclosure.
Figure 3A:
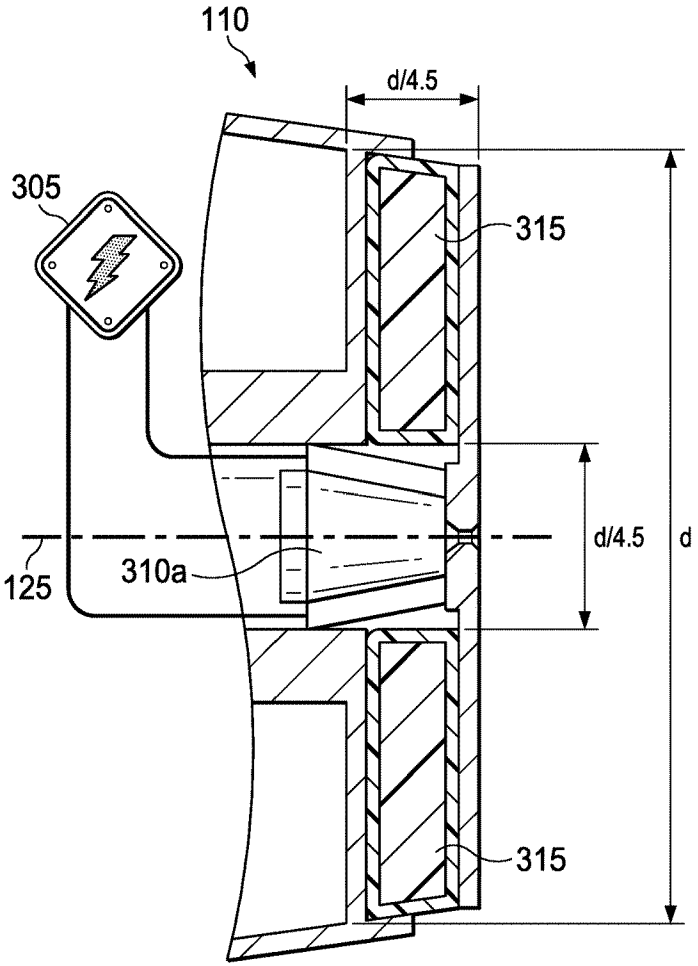

In an embodiment, the fairing 130, the one or more control surfaces 115, and the one or more fins 120 can comprise an SMM. FIGS. 3A and 3B illustrate an example of the device base 110 of the device 100 according to this disclosure. The device base 110 includes an activation device 305, a stimulus producing device 310*a*, a stimulus 310*b*, and an SMM material 315. After the device 100 leaves a barrel of an artillery gun from which it is fired, the activation device 305 transmits a signal (such as an electric current) to the stimulus producing device 310*a*. In response to receiving the signal from the activation device 305, the stimulus producing device 310*a* produces a stimulus 310*b*, such as a change in temperature. The stimulus 310*b* energizes the SMM material 315 to change shape from a compact shape (as shown in FIG. 3A) to an expanded shape (as shown in FIG. 3B) forming and deploying the fairing 130. The device base 110 uses a solid state mechanism that takes up less space on the device 100 and weighs less than convention mechanisms. Prototyping of deployable components can be quick with 3-D printing of SMP mechanisms. The device base 110 also provides greatly reduced shock when components are deployed relative to explosive alternatives.

As shown in FIG. 3A, the stimulus producing unit 310*a* can be positioned so that the device axis 125 travels through the center of the stimulus producing unit 310*a*. The area to discharge the stimulus can be a ratio of d/4.5 or the diameter of the device base 110 divided by 4.5. The storage depth of the SMM material 315 can also be d/4.5 or the diameter of the device base 110 divided by 4.5. In an embodiment, the diameter d of the device base 110 is 4.5 inches, although in other embodiments the diameter d could be smaller or larger.

Although FIGS. 3A and 3B illustrate one example device base 110 of a device 100, various changes may be made to FIGS. 3A and 3B. For example, the example device base 110 could be used with any other type of device 100 including a missile, a rocket, a submersible, or the like. Also, the makeup and arrangement of the device base 110 in FIGS. 3A and 3B is for illustration only. Components could be added, omitted, combined, or placed in any other suitable configuration according to particular needs.

Figure 4:
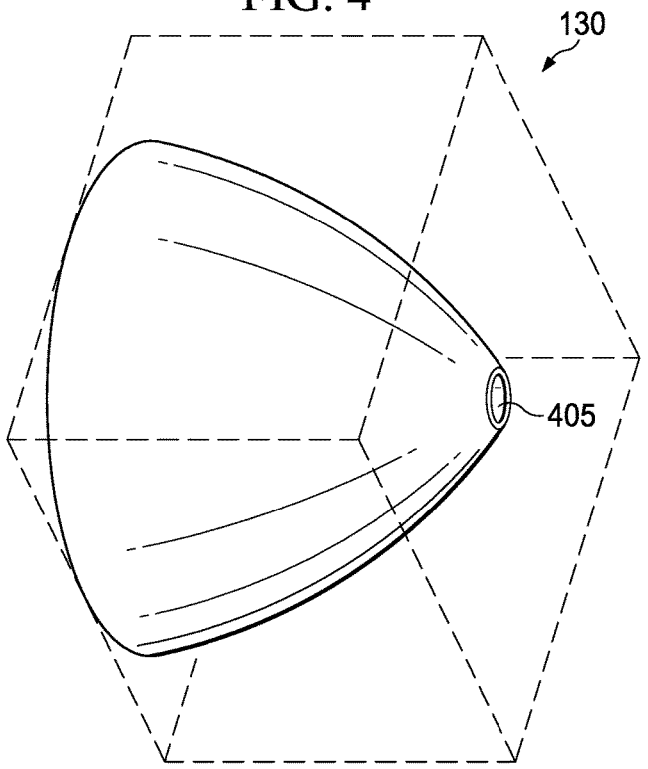
FIG. 4 illustrates an example fairing according to this disclosure.

FIG. 4 illustrates an example of the fairing 130 according to this disclosure. As shown in FIG. 4, the fairing 130 includes a cone-like shape with an opening 405 to dispose device propellant. In an embodiment, the fairing 130 can include a dome shape, a pyramid shape, a trapezoidal shape, or the like. The fairing 130 can include any shape that aligns with the cross-sectional shape of the device body 105.

Although FIG. 4 illustrates one example fairing 130, various changes may be made to FIG. 4. Also, the makeup and arrangement of the fairing 130 in FIG. 4 is for illustration only. Components could be added, omitted, combined, or placed in any other suitable configuration according to particular needs.

Figure 5:
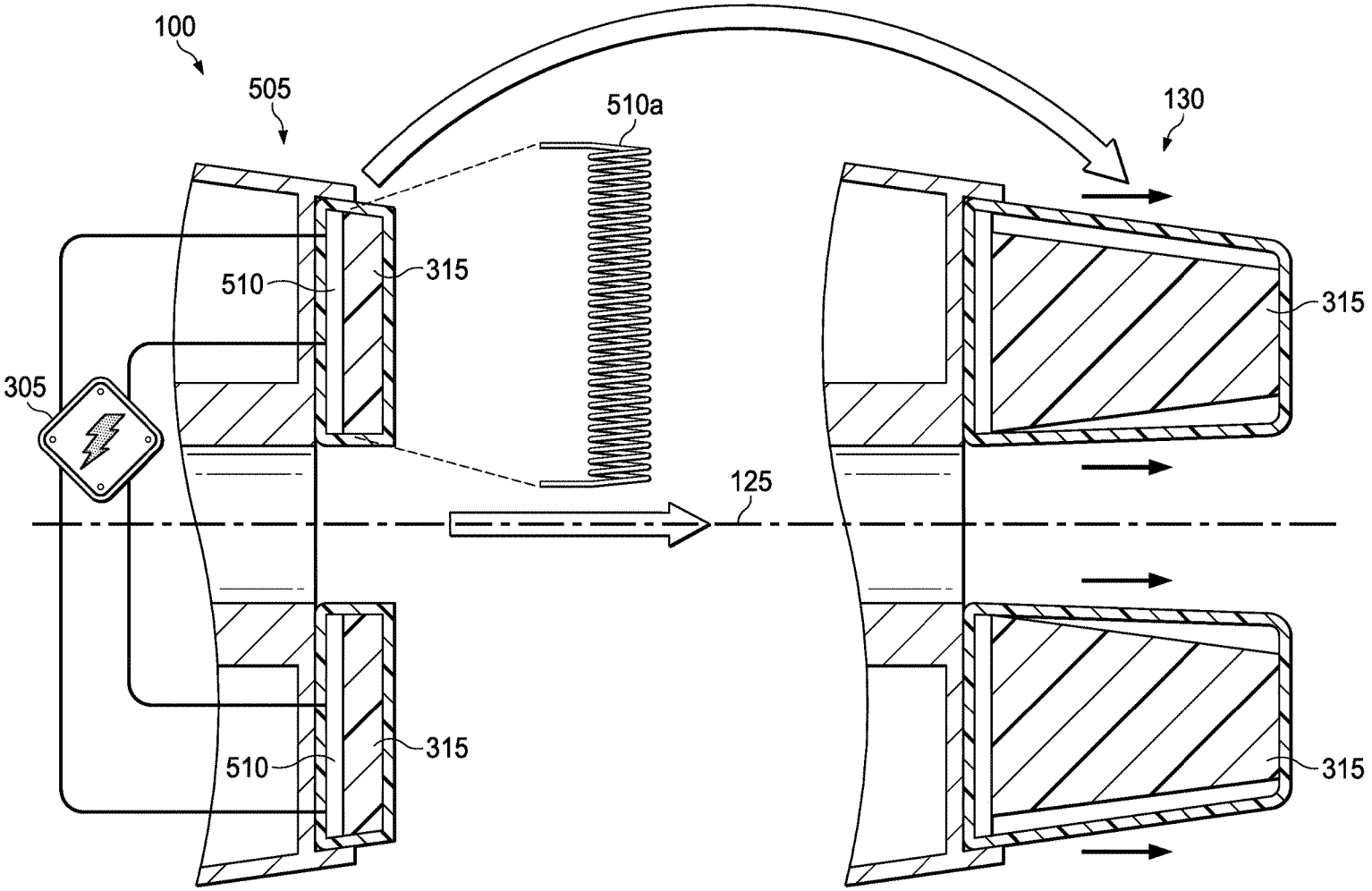
FIGS. 5 and 6 illustrate example device bases of a projected device according to this disclosure.

FIG. 5 illustrates an example device base 505 of a device 100 according to this disclosure. The example device base 505 of a device illustrated in FIG. 5 could be the device base 110 of a device 100 illustrated in FIGS. 1, 2, 3A, and 3B. The device base 505 includes an activation device 305, a stimulus producing device 510, and an SMM material 315. After the device 100 leaves a barrel of an artillery gun from which it is fired, the activation device 305 transmits a signal (such as an electric current) to the stimulus producing device 510. In response to receiving the signal from the activation device 305, the stimulus producing device 510 produces a stimulus, such as heat. As shown in FIG. 5 the stimulus producing device 510 can be a heat generating electric coil 510*a*. The heat from the coil 510*a* energizes the SMM material 315 to change shape from a compact shape to an expanded shape forming and deploying the fairing 130.

Although FIG. 5 illustrates one example device base 505 of a device, various changes may be made to FIG. 5. For example, the example device base 505 could be used with any other type of device 100 including a missile, a rocket, a submersible, or the like. Also, the makeup and arrangement of the device base 505 in FIG. 5 is for illustration only. Components could be added, omitted, combined, or placed in any other suitable configuration according to particular needs.

Figure 6:
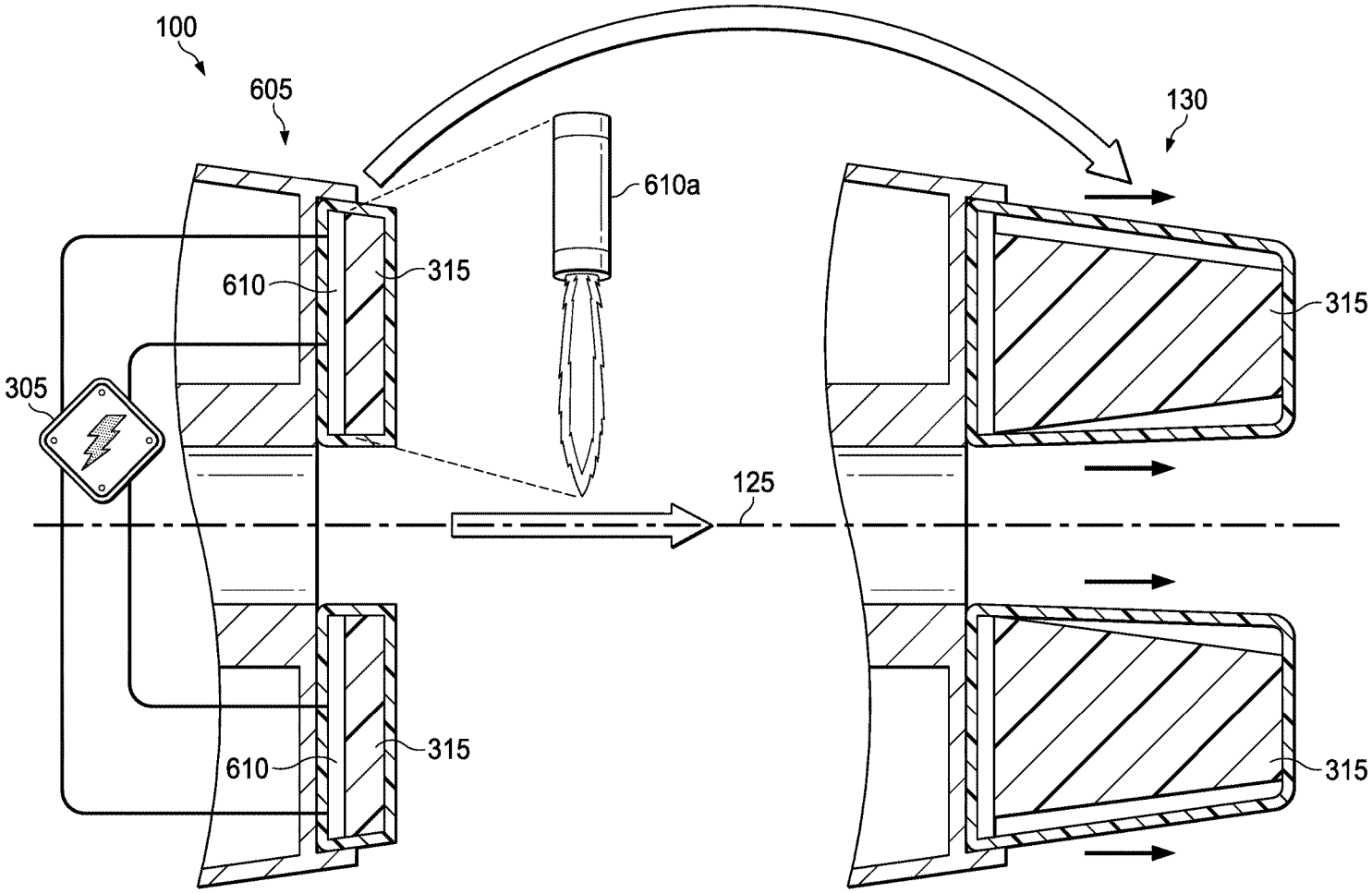

FIG. 6 illustrates an example device base 605 of a device 100 according to this disclosure. The example device base 605 of a device illustrated in FIG. 6 could be the device base 110 of a device 100 illustrated in FIGS. 1, 2, 3A, and 3B. The device base 605 includes an activation device 305, a stimulus producing device 610, and an SMM material 315. After the device 100 leaves a barrel of an artillery gun from which it is fired, the activation device 305 transmits a signal (such as an electric current) to the stimulus producing device 610. In response to receiving the signal from the activation device 305, the stimulus producing device 610 produces a stimulus, such as heat. As shown in FIG. 6 the stimulus producing device 610 can be a flame or heated gas 610*a*. The flame 610*a* energizes the SMM material 315 to change shape from a compact shape to an expanded shape forming and deploying the fairing 130.

Although FIG. 6 illustrates one example device base 605 of a device, various changes may be made to FIG. 6. For example, the example device base 605 could be used with any other type of device 100 including a missile, a rocket, a submersible, or the like. Also, the makeup and arrangement of the device base 605 in FIG. 6 is for illustration only. Components could be added, omitted, combined, or placed in any other suitable configuration according to particular needs.

The concepts disclosed herein can be used to deploy one or more control surfaces 115 or one or more fins 120. For example, after the device 100 leaves a barrel of an artillery gun from which it is fired, an activation device 305 transmits a signal (such as an electric current) to the stimulus producing device 510. In response to receiving the signal from the activation device 305, the stimulus producing device 510 produces a stimulus, such as heat. The stimulus producing device 510 can be a heat generating electric coil 510*a* or a flame 610*a*. The heat from the coil 510*a* or the flame 610*a* energizes the SMM material 315 to change shape from a compact shape to an expanded shape forming and deploying one or more control surfaces 115 or one or more fins 120.

The concepts disclosed herein can also be used to fill spaces or gaps 135 and 140 left after one or more control surfaces 115 or one or more fins 120 are deployed. For example, after the device 100 leaves a barrel of an artillery gun from which it is fired and one or more control surfaces 115 or one or more fins 120 are deployed, an activation device 305 transmits a signal (such as an electric current) to the stimulus producing device 510, 610. In response to receiving the signal from the activation device 305, the stimulus producing device 510, 610 produces a stimulus, such as heat. The stimulus producing device 510, 610 can be a heat generating electric coil 510*a* or a flame 610*a*. The heat from the coil 510*a* or the flame 610*a* energizes the SMM material 315 to change shape from a compact shape to an expanded shape filling spaces or gaps 135 and 140 left after the one or more control surfaces 115 or one or more fins 120 are deployed.

Figure 7:
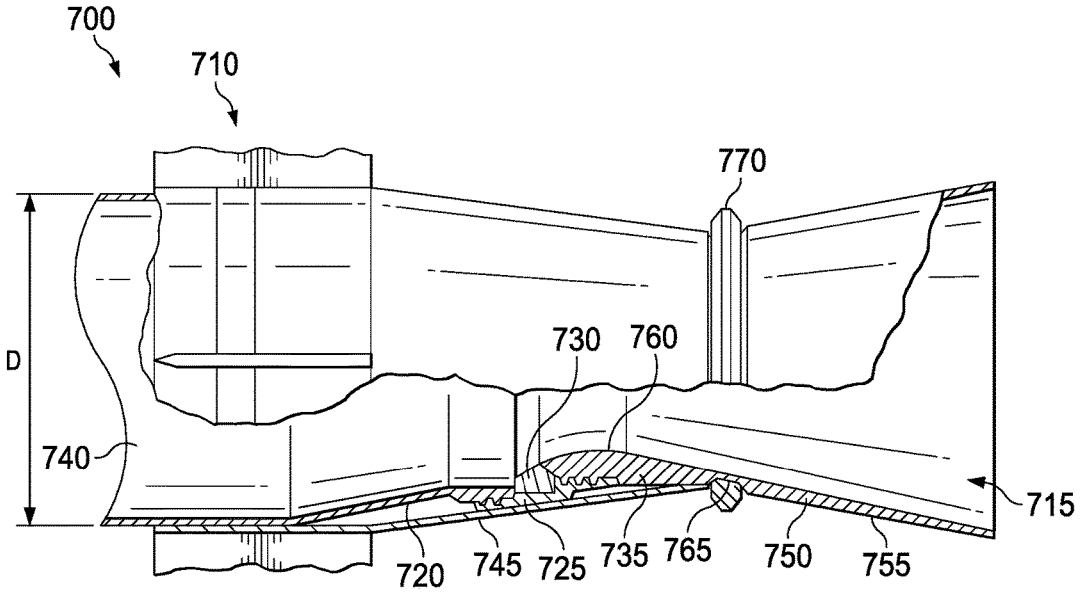
FIG. 7 illustrates another example device base of a device according to this disclosure.

In an embodiment, a component comprising an SMM can be activated to deploy the fairing 130, the one or more control surfaces 115, and the one or more fins 120. FIG. 7 illustrates an example device base 710 of a device 700 according to this disclosure. The example device base 710 of a device illustrated in FIG. 7 could be the device base 110 of a device illustrated in FIGS. 1, 2, 3A, and 3B. The device base 710 includes a nozzle section 715 with an internal diameter D and a tapered end structure that, when installed to the main device body, receives support structure 720 that has aerodynamic surface or fins 14 mounted thereon in a conventional manner. An adapter 725 may be threaded on the end of the nozzle section 715 and helps support the support structure 720. Inserts like that of inserts 730, 735, 750, and 760 may be mounted inside adapter 725 and forms a portion of the nozzle structure. Additional joints may be employed to assemble the total nozzle, like that were insert 735 is threaded to adapter 725 to complete the nozzle structure for the rocket motor. Conventional rocket motor propellant for housing 740 is provided in practice but not illustrated herein.

A fairing outer housing structure 745 is secured to adapter 725 in a conventional manner to form a fairing structure for the missile when end portion 750 of the device nozzle is severed. It is also pointed out that fairing structure 745 is approximately 1-caliber in length and of a length which is approximately equal to diameter D. Fairing structure 745 has an outer surface 805 (illustrated in FIG. 8) that tapers inwardly to a point of tangency to outer surface 755 of end portion 750. As noted, end portion 750 is somewhat aft of main motor nozzle throat 760. At the point of tangency between surface 755 and end portion 750, the nozzle has a circumferential groove 765 therearound to weaken the nozzle structure.

A frangible solid-state ring 770 including SMM is mounted circumferentially relative to groove 765 and provides a means for cutting and severing the rear nozzle portion with tapered surface 755 to provide the device with a fairing structure, for example, after the device 700 has been launched in a boost phase and is in a coast phase. The frangible solid-state ring 770 including SMM can interact with an activation device and a stimulus producing device as discussed herein. In operation, device propulsion is activated and thrust develops to launch the device 700 in its predetermined trajectory. At the time of booster burnout or device propulsion burnout, a timer which has been pre-programmed causes an activation device to send a signal to a stimulus producing device, which causes the component 770 to expand or contract. The component 770 is circumferentially around the device nozzle.

Figure 8:
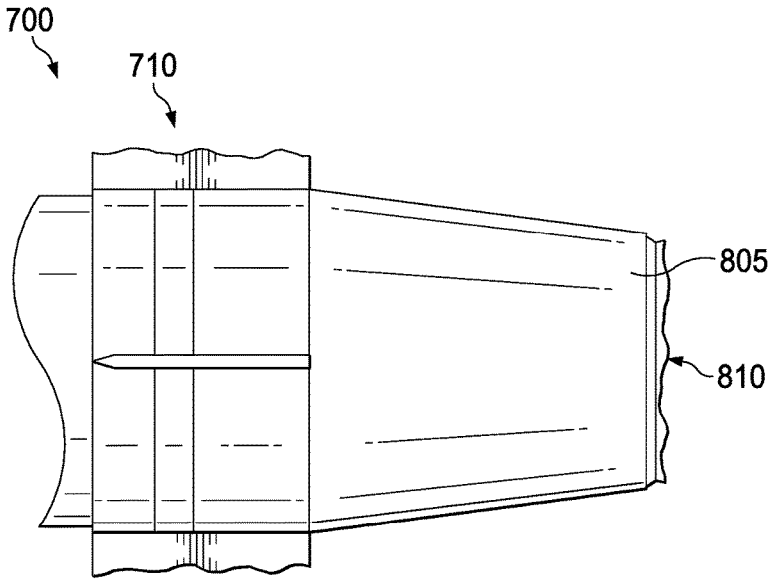
FIG. 8 illustrates an example device base according to this disclosure.

When the frangible solid-state ring 770 which is circumferentially around the nozzle is exposed to a stimulus, such as change in temperature, the component 770 expands or contracts. The expansion or contraction of the component 770 causes the end portion of the nozzle to sever at point 810 from the remaining portion of the nozzle and provides a tapered fairing end structure surface 805. This fairing end structure configuration of the device is highly effective in reducing drag and increasing range over non-fairing configurations. Although FIGS. 7 and 8 illustrate one example device base 710 of a device, various changes may be made to FIGS. 7 and 8. Also, the makeup and arrangement of the device base 710 in FIGS. 7 and 8 are for illustration only. Components could be added, omitted, combined, or placed in any other suitable configuration according to particular needs.

The concepts disclosed herein can also be used to deploy one or more control surfaces or one or more fins as disclosed herein. For example, after the device leaves a barrel of an artillery gun from which it is fired, an activation device transmits a signal (such as an electric current) to the stimulus producing device 510. In response to receiving the signal from the activation device, the stimulus producing device 510 produces a stimulus, such as heat or a change in temperature. The stimulus producing device 510 can be a heat generating electric coil or a flame. The heat from the coil or the flame energizes the SMM material to change shape and cause one or more control surfaces or one or more fins to deploy from the device.

The concepts disclosed herein can also be used to fill spaces or gaps left after one or more control surfaces or one or more fins are deployed. For example, after the device leaves a barrel of an artillery gun from which it is fired and one or more control surfaces or one or more fins are deployed, an activation device transmits a signal (such as an electric current) to the stimulus producing device 510. In response to receiving the signal from the activation device, the stimulus producing device 510 produces a stimulus, such as heat or a change in temperature. The stimulus producing device 510 can be a heat generating electric coil or a flame. The heat from the coil or the flame energizes SMM material to change shape and cause one or more components to fill spaces or gaps left after the one or more control surfaces or one or more fins are deployed.

Figure 9:
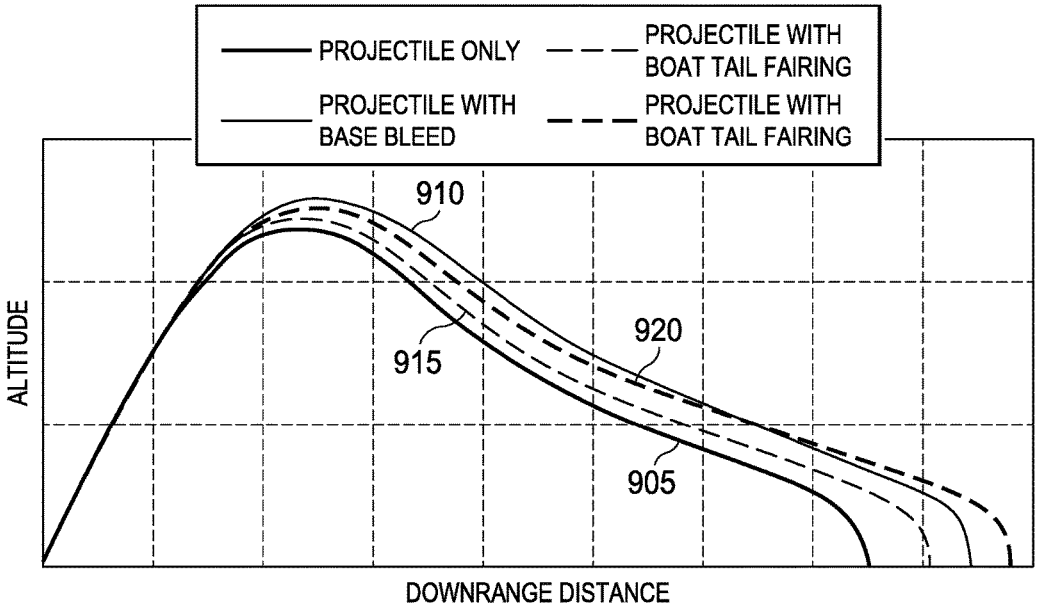
FIG. 9 illustrates an example graph showing a simulated performance of various artillery devices according to this disclosure.

FIG. 9 illustrates an example graph 900 showing a simulated performance of various devices according to this disclosure. Specifically, FIG. 9 shows a graph 900 of the altitude and down-range distance for various devices using identical firing conditions. The solid line 905 shows the performance of a device that does not have base bleed or a base drag reduction fairing. The range of the device without base bleed or a base drag reduction fairing travels the least distance. The dashed line 910 shows the altitude and down-range distance for the same projected device with the addition of base bleed. The range of the device with base bleed is greater than the range of the projected device without base bleed or a base drag reduction fairing. Thus, for the simulated conditions, the incorporation of base bleed increases the range of the device when launched.

The broken lines 915, 920 show the altitude and down-range distance for the same device with the addition of base drag reduction fairings. The line 915 shows that the range of the device with a base drag reduction fairing is greater than the device represented by lines 905 and 910. The line 920 shows the range of the device with a base drag reduction fairing that is longer than the base drag reduction fairing on the device represented by line 915. The range of the device represented by line 920 is greater than the devices represented by lines 905, 910, and 015. Thus, for the simulated conditions, a base drag reduction fairing may increase the range of the device when launched depending on the length of the fairing. Although the specific design was not simulated, FIG. 9 indicates that the performance of a device with a base drag reduction fairing may be about equal to the performance of a device with base bleed if the length of the base drag reduction fairing is about equal to the diameter of the device.

Figure 10:
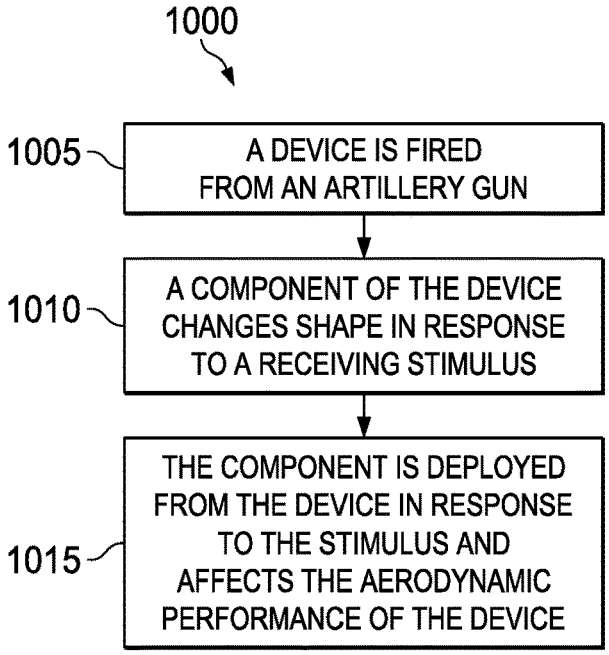
FIG. 10 illustrates an example method implemented by a device according to this disclosure.

FIG. 10 illustrates an example method 1000 implemented by a device 100 according to this disclosure. At step 1005, the device 100 is fired from an artillery gun. At step 1010, a component of the device 100 changes shape in response to receiving a stimulus. The component includes a shape memory material (SMM). The component is one of a fairing 130, a control surface 115, or a fin 120. At step 1015, the component is deployed from a device body 105 of the device 100 in response to receiving the stimulus and affects the aerodynamic performance of the device. The device includes one of a missile, a rocket, or a submersible. The SMM includes one of a shape memory polymer (SMP) or a shape memory alloy (SMA). Although FIG. 10 illustrates one example of a method 1000, various changes may be made to FIG. 10 without departing from the scope of this disclosure.

Figure 11:
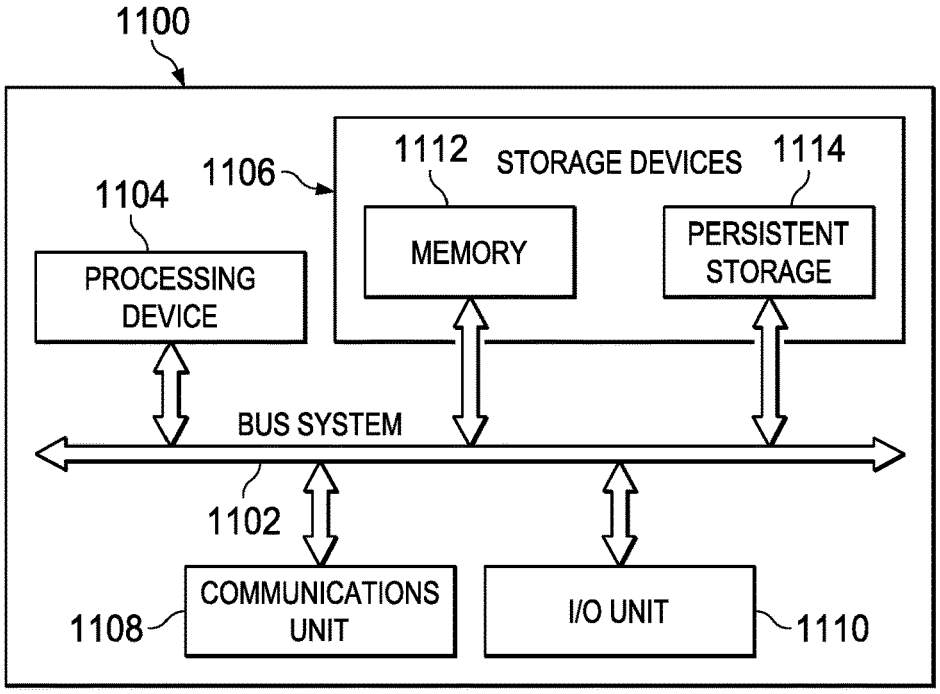
FIG. 11 illustrates an example computing device that may be used for controlling the methods and components according to this disclosure.

FIG. 11 illustrates an example computing device 1100 that may be used for controlling the methods and components according to this disclosure. As shown in FIG. 11, the device 1100 includes a bus system 1102, which supports communication between at least one processing device 1104, at least one storage device 1106, at least one communications unit 1108, and at least one input/output (I/O) unit 1110.

The processing device 1104 executes instructions that may be loaded into a memory 1112. The processing device 1104 may include any suitable number(s) and type(s) of processors or other devices in any suitable arrangement. Example types of processing devices 1204 include microprocessors, microcontrollers, digital signal processors, field programmable gate arrays, application specific integrated circuits, and discrete circuitry.

The memory 1112 and a persistent storage 1114 are examples of storage devices 1106, which represent any structure(s) capable of storing and facilitating retrieval of information (such as data, program code, and/or other suitable information on a temporary or permanent basis). The memory 1112 may represent a random access memory or any other suitable volatile or non-volatile storage device(s). The persistent storage 1114 may contain one or more components or devices supporting longer-term storage of data, such as a ready only memory, hard drive, Flash memory, or optical disc.

The communications unit 1108 supports communications with other systems or devices. For example, the communications unit 1108 could include a network interface card that facilitates communications over at least one wireless network. The communications unit 1108 could also include a wireless transceiver facilitating communications over at least one wireless network. The communications unit 1108 may support communications through any suitable physical or wireless communication link(s). The I/O unit 1110 allows for input and output of data. For example, the I/O unit 1110 may provide a connection for input indicating that the device has been fired.

Although FIGS. 1 through 11 illustrate an example device and various components of an example device, various changes may be made to FIGS. 1 through 11. For example, it will be understood that well-known processes have not been described in detail and have been omitted for brevity. Although specific steps, structures and materials may have been described, this disclosure may not be limited to these specifics, and others may be substituted as it is well understood by those skilled in the art, and various steps may not necessarily be performed in the sequences shown.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

To aid the Patent Office, and any readers of any patent issued on this application in interpreting the claims appended hereto, applicants wish to note that they do not intend any of the appended claims or claim elements to invoke 35 U.S.C. Section 112(f) as it exists on the date of filing hereof unless the words "means for" or "step for" are explicitly used in the particular claim.

What is claimed is:

1. A device comprising:

at least one first shape memory material (SMM) component and at least one second SMM component each fabricated from an SMM and configured to change shape in response to receiving a stimulus;

wherein the at least one first SMM component is configured to deploy from a device body of the device and change a shape of the device; and wherein the at least one second SMM component is configured to cover or fill at least one space in the device body created by deployment of the at least one first SMM component.

2. The device of claim 1, further comprising one or more activation devices each configured to generate an electrical signal to activate the stimulus of at least one of the SMM components.

3. The device of claim 1, further comprising at least one retention device configured to retain the at least one first SMM component in a contracted state.

4. The device of claim 1, wherein at least one of a heating coil or a flame producing device is configured to generate the stimulus that activates at least one of the SMM components.

5. The device of claim 1, wherein the at least one first SMM component is configured to expand into a fairing at a base of the device body.

6. The device of claim 1, wherein each of the SMM components comprises one of a shape memory polymer (SMP) or a shape memory alloy (SMA).

7. The device of claim 1, wherein the at least one first SMM component is configured to expand from the device body into at least one of: at least one control surface or at least one fin.

8. A device comprising:

at least one first shape memory material (SMM) component and at least one second SMM component each fabricated from an SMM and configured to change shape in response to receiving a stimulus;

wherein the at least one first SMM component is configured to cause at least one deployable component to deploy from a device body of the device and change a shape of the device; and wherein the at least one second SMM component is configured to cover or fill at least one space in the device body created by deployment of the at least one deployable component.

9. The device of claim 8, further comprising one or more activation devices each configured to generate an electrical signal to activate the stimulus of at least one of the SMM components.

10. The device of claim 9, wherein the stimulus that activates at least one of the SMM components comprises a change in temperature.

11. The device of claim 8, wherein at least one of a heating coil or a flame producing device is configured to generate the stimulus that activates at least one of the SMM components.

12. A device comprising:

at least one shape memory material (SMM) component fabricated from an SMM and configured to:

change shape in response to receiving a stimulus;

cause at least one deployable component to deploy from a device body of the device; and change a shape of the device;

wherein the at least one SMM component is configured to sever an expansion portion of a nozzle at a base of the device body to deploy a fairing.

13. The device of claim 8, wherein each of the SMM components comprises one of a shape memory polymer (SMP) or a shape memory alloy (SMA).

14. The device of claim 8, wherein the at least one first SMM component is configured to cause the at least one deployable component to deploy from the device body into at least one of: at least one control surface or at least one fin.

15. The device of claim 12, wherein the device further comprises at least one second SMM component configured to change shape and cover or fill at least one space in the device body created by deployment of the at least one deployable component.

16. A method implemented using a device that includes at least one first shape memory material (SMM) component and at least one second SMM component each fabricated from an SMM, the method comprising:

changing a shape of the at least one first SMM component of the device in response to receiving a stimulus;

deploying the at least one first SMM component or at least one deployable component from a device body of the device;

changing a shape of the device; and using the at least one second SMM component to cover or fill at least one space in the device body created by deployment of the at least one first SMM component or the at least one deployable component.

17. The method of claim 16, wherein the stimulus is received after the device is fired from an artillery gun.

18. The method of claim 16, wherein the device comprises one of a mortar, a bullet, a grenade, a missile, a rocket, or a submersible.

19. The method of claim 16, wherein each of the SMM components comprises one of a shape memory polymer (SMP) or a shape memory alloy (SMA).

20. The method of claim 16, wherein the at least one first SMM component or the at least one deployable component comprises one or more of: a fairing, at least one control surface, or at least one fin.

* * * * *